US012129746B2

(12) United States Patent
Wu et al.

(10) Patent No.: US 12,129,746 B2
(45) Date of Patent: Oct. 29, 2024

(54) MULTI-PHASE CONTROLLED MULTI-WELL PUMPING UNIT

(71) Applicant: CHINA INTELLIGENT OIL RECOVERY TECHNOLOGY CO., LTD., Tianjin (CN)

(72) Inventors: Xingcai Wu, Tianjin (CN); Xiuting Han, Tianjin (CN); Hongbao Liang, Tianjin (CN); Hongtao Chen, Tianjin (CN); Mei Han, Tianjin (CN); Yan Zhang, Tianjin (CN); Zhenqiang Jiao, Tianjin (CN); Yan Zhang, Tianjin (CN)

(73) Assignee: CHINA INTELLIGENT OIL RECOVERY TECHNOLOGY CO., LTD., Tianjin (CN)

( * ) Notice: Subject to any disclaimer, the term of this patent is extended or adjusted under 35 U.S.C. 154(b) by 0 days.

(21) Appl. No.: 17/760,634

(22) PCT Filed: Sep. 8, 2021

(86) PCT No.: PCT/CN2021/117064
§ 371 (c)(1),
(2) Date: Mar. 15, 2022

(87) PCT Pub. No.: WO2022/205773
PCT Pub. Date: Oct. 6, 2022

(65) Prior Publication Data

US 2024/0044231 A1 Feb. 8, 2024

(30) Foreign Application Priority Data

Apr. 1, 2021 (CN) ..... 202110354245.4

(51) Int. Cl.
*E21B 43/12* (2006.01)

(52) U.S. Cl.
CPC ..... *E21B 43/126* (2013.01)

(58) Field of Classification Search
CPC ..... E21B 43/126; E21B 43/127
See application file for complete search history.

(56) References Cited

U.S. PATENT DOCUMENTS 4,997,346 A 3/1991 Bohon
10,577,904 B1 * 3/2020 Dreher ..... F04B 47/14
(Continued)

FOREIGN PATENT DOCUMENTS

CN 2058947 U 7/1990
CN 101113665 A 1/2008
(Continued)

*Primary Examiner* — Christopher J Sebesta

(57) ABSTRACT

The present invention provides a multi-phase controlled multi-well pumping unit and relates to an oil exploitation device. The multi-phase controlled multi-well pumping unit includes: a power part, where include a rotating shaft; a crank part, where the crank part includes two crank mechanisms, and a power output part, where the power output part includes a plurality of flexible-power-rope guide components. The pumping unit drives the dual cranks by two ends of the rotating shaft to serve as a power source, and the dual-crank power output mechanism leads out a plurality of groups of flexible power ropes to drive, by using the uniformly distributed guide components, a plurality of pumping wells to operate. Such practice can effectively reduce energy consumption of the multi-well pumping unit system and further improve efficiency.

13 Claims, 4 Drawing Sheets

(56) References Cited

U.S. PATENT DOCUMENTS

| | | | | |
|---|---|---|---|---|
| 2013/0302183 | A1* | 11/2013 | Gregory | F04B 17/006 417/53 |
| 2019/0071938 | A1* | 3/2019 | Taraldrud | E21B 19/008 |
| 2022/0195847 | A1* | 6/2022 | Redmond | E21B 41/0085 |

FOREIGN PATENT DOCUMENTS

| | | | |
|---|---|---|---|
| CN | 101545364 | A | 9/2009 |
| CN | 201321847 | Y | 10/2009 |
| CN | 101644152 | A | 2/2010 |
| CN | 210289723 | U | 4/2020 |
| CN | 113153227 | A | 7/2021 |
| CN | 113445991 | A | 9/2021 |
| CN | 215057278 | U | 12/2021 |

* cited by examiner

MULTI-PHASE CONTROLLED MULTI-WELL PUMPING UNIT

TECHNICAL FIELD

The present invention relates to oil exploitation devices, and in particular, to a multi-phase controlled multi-well pumping unit.

BACKGROUND

In recent years, the oil prices have been sluggish, and oil field exploitation benefits deteriorate year by year. There are more than 2 million pumping wells in oil fields worldwide, and 400,000-500,000 in China, most of which pump oil by using pumping units. Although pumping units have been developed for nearly one hundred years, no major technological breakthrough is made. Consequently, existing pumping units generally have problems such as high energy consumption, a large volume, a heavy weight, and low oil pumping efficiency and benefits. Therefore, it is in line with the development trend of the oil industry to study and invent an efficient, high-end and intelligent pumping unit to increase the exploitation benefits. In an environment that emphasizes safety and environmental protection and is confronted with shortage of land resources, it is urgent to design an oil pumping device with low energy consumption and high oil pumping efficiency.

SUMMARY

The present invention aim to solve at least one of the technical problems existing in the prior art or related technologies, and provides a multi-phase controlled multi-well pumping unit, which effectively reduces energy consumption of a multi-well pumping unit system and further improves efficiency.

The present invention is implemented by the following technical solution: A multi-phase controlled multi-well pumping unit includes: a power part, where the power part outputs torque through a rotating shaft; a crank part, where the crank part includes two crank mechanisms, the two crank mechanisms are fixedly connected to two end parts of the rotating shaft respectively, and a free end of each of the crank mechanisms is connected to flexible power ropes; a power output part, where the power output part includes a plurality of flexible-power-rope guide components distributed in different phases (angles) along the radial direction of the output shaft (vertical output shaft), and the plurality of flexible-power-rope guide components are fixed to a power output frame; where the free end of each of the crank mechanisms is fixedly connected to one ends of the flexible power ropes, and the other ends of the flexible power ropes provide power output to the outside through the flexible-power-rope guide components. The symmetrical crank mechanisms each drive a plurality of flexible power ropes to output power, two flexible power ropes moving synchronously jointly drive one pumping well, and a plurality of flexible power ropes restrict a direction of power output through the power output part, so that the crank mechanisms are stressed in a balanced manner when performing circumferential movement, and a load is reduced.

In the technical solution, the rotating shaft of the power part is configured as a single shaft with dual outputs, and the frame has a compact structure, that is, the two crank mechanisms are fixed at two ends of the rotating shaft, and the crank mechanisms perform circumferential movement around the rotating shaft. The synchronous rotation of the two cranks drives the plurality of groups of flexible power ropes to reciprocate to output power, so that the rotating shaft and the frame are properly stressed. The plurality of groups of flexible power ropes and the flexible-power-rope guide components with uniformly distributed phases (for example, universal fixed pulleys) drive 3-25 or even more wells. Pumping wells may be uniformly distributed on the same straight line, or may be arranged non-uniformly and nonlinearly. A lateral foundation ensures lateral stress balance of a power base, and balance in a linear direction depends on stress balance among multiple wells. The universal fixed pulleys achieve mechanical and dynamic balance in the process of energy transmission of the multi-well pumping unit, simplify the system structure, enable the multi-well pumping unit to have a proper system structure and be properly stressed, and bring functions and superior characteristics of the multi-well pumping unit into better play. A universal pulley block system is used to optimize the structure layout, and the foundation, the frame, the pulley block, a wheel connection system and an adjustment mechanism are used to achieve main functions: the flexible power ropes fall to the ground, power transmission on both sides is unified, an angle of transmission from the flexible power ropes to a single well is accurately changed, and power of a main engine of the pumping unit is properly transmitted to each driven single well for reciprocating oil pumping. The stroke and balance of a single well can be adjusted by a wellhead power conversion apparatus; and a higher yield and lower energy consumption can also be achieved by arranging a non-leakage oil well pump.

The multi-phase controlled multi-well pumping unit according to the present invention preferably further includes wellhead stroke adjustment mechanisms, where the wellhead stroke adjustment mechanisms each specifically include an input pulley, a component for adjusting an effective length of a flexible power rope, and an output pulley, and each of the flexible power ropes is connected to the component for adjusting an effective length of a flexible power rope through the input pulley, and is connected to a wellhead oil pumping component through the output pulley after an effective length of the flexible power rope is adjusted.

In this technical solution, coaxial pulleys (rollers) with different diameters are used to change a diameter combination and adjust a reciprocating stroke length. A flexible-power-rope input end from the power part is fixed to a fixed pulley with one diameter, and a flexible-rope output end that is connected to a wellhead rope hanger is fixed to another fixed pulley with a different diameter. Reciprocating motion is performed under the two-way restriction of main power of the power part and a sucker rod pump. Independent stroke adjustment of an oil pumping component in each pumping well is achieved, which plays an important role in flexible adjustment and stable operation of the multi-well pumping unit system.

The multi-phase controlled multi-well pumping unit according to the present invention preferably further includes single-well shutdown balance mechanisms, where each of the single-well shutdown balance mechanisms specifically includes a balance rope, a balance counterweight, a plurality of input pulleys, a plurality of flexible-power-rope control sliding sleeves, a plurality of hooks, a plurality of hook connecting ropes, and a plurality of limit blocks, where the flexible power ropes led out by the flexible-power-rope guide components run through the input pulleys and the flexible-power-rope control sliding sleeves to output power to the outside, the limit blocks are fixed to the flexible power ropes on an output side of the flexible-power-rope control sliding sleeves, one ends of the hook connecting ropes are connected to the hooks, and the other ends of the hook connecting ropes are connected to the flexible-power-rope control sliding sleeves; and after the flexible power ropes lose wellhead tension, the limit blocks drive the flexible-power-rope control sliding sleeves to move and further drive the hooks to move, so that the hooks are hung on the balance rope, and the balance rope drives the balance counterweight to reciprocate up and down to simulate the wellhead tension.

In this technical solution, when the pumping unit drives a plurality of pumping wells to operate, upon a pumping stop caused by a single-well fault, the single-well shutdown balance mechanism converts a load of the faulted well into a standby load, so as to avoid affecting the normal operation of the system and an operating time rate of the multi-well pumping unit.

The multi-phase controlled multi-well pumping unit according to the present invention preferably further includes a flexible-power-rope quick disconnection mechanism, where the flexible-power-rope quick disconnection mechanism specifically includes a flexible-power-rope input end, a control rope, a sleeving mechanism, a disconnection clamping claw, and a flexible-power-rope output end that are connected in sequence; the sleeving mechanism includes an outer sleeve and an inner sleeve, and the disconnection clamping claw is disposed in the sleeving mechanism to fix the outer sleeve and the inner sleeve; and each of the flexible power ropes pulls the control rope after being overloaded, and the control rope further drives the outer sleeve to move to trigger the disconnection clamping claw, so that the outer sleeve is separated from the inner sleeve.

In this technical solution, as a weak link in a pumping unit power transmission system, the flexible-power-rope quick disconnection mechanism provides an overload protection function, and a tension sensor may be further disposed on the flexible-power-rope quick disconnection mechanism to calculate a single-well load.

The multi-phase controlled multi-well pumping unit according to the present invention preferably further includes an artificial intelligence management system, where the artificial intelligence management system includes an electrical parameter collection apparatus and a flexible rope tension detection apparatus, which are configured to collect electrical parameters of the pumping unit and stress data of a single-well flexible rope and upload the electrical parameters and the stress data to an oil field management cloud platform.

In this technical solution, the pumping unit system supports arrangement of a single-well load displacement sensor and matched intelligent system software, to intelligently calculate a single-well fluid flow pressure, diagnose and analyze more than 100 working condition items of a pump, and achieve adjustment of the main engine related to the system stroke and stroke times and optimal control over machines, pumps, wells and layers and between wells.

In the multi-phase controlled multi-well pumping unit according to the present invention, preferably, the rotating shaft is located at the center of the power output frame.

In the multi-phase controlled multi-well pumping unit according to the present invention, preferably, the power part specifically includes a motor and a reducer, where the motor and the reducer are connected by a transmission mechanism, and a power output shaft of the reducer serves as the rotating shaft.

In the multi-phase controlled multi-well pumping unit according to the present invention, preferably, the transmission mechanism specifically includes an overload clutch, a chain sprockets, and a transmission shaft, where the overload clutch and the sprocket are coaxially connected to the motor through the transmission shaft, and the chain connects a motor sprocket to a reducer sprocket, so that the motor drives the reducer.

In the multi-phase controlled multi-well pumping unit according to the present invention, preferably, each of the crank mechanisms specifically includes a crank and a flexible-power-rope connecting disc, the flexible-power-rope connecting disc is fixed to a free end of the crank, and the flexible-power-rope connecting disc is provided with a plurality of flexible-power-rope fixing holes.

In the multi-phase controlled multi-well pumping unit according to the present invention, preferably, each of the flexible-power-rope guide components specifically includes a horizontal shaft and two pulleys fixed to the horizontal shaft; and the power output frame specifically includes a frame, a first track, and a second track, the first track and the second track have the same structure and are coaxially fixed to the frame, and two ends of the horizontal shaft are vertically fixed between the first track and the second track.

In the multi-phase controlled multi-well pumping unit according to the present invention, preferably, the first track and the second track are circular or regular polygons.

The multi-phase controlled multi-well pumping unit according to the present invention preferably further includes an electric control box, where the electric control box is connected to the power part.

The multi-phase controlled multi-well pumping unit according to the present invention preferably further includes a braking apparatus, where the braking apparatus is connected to the power part.

The multi-phase controlled multi-well pumping unit according to the present invention preferably further includes a non-leakage oil well pump disposed in a pumping well, where the flexible power ropes are connected to the non-leakage oil well pump through a sucker rod.

The present invention has at least the following beneficial effects: The pumping unit system drives the dual cranks by two ends of the rotating shaft to serve as a power source, and the dual-crank power output mechanism leads out a plurality of groups of flexible power ropes to drive, by using the uniformly distributed guide components, a plurality of pumping wells to operate. Well-to-well inefficacy load (sucker rod weights) counteracts each other, and uniform distribution of alternating loads tends to be constant. The stress on the system is reasonable and tends to be constant. A motor tends to be efficient in working. Such practice solves problems such as improper stress, high energy consumption, and low efficiency in oil pumping using a conventional walking beam, and achieves objectives of greatly saving energy, improving efficiency and reducing device investment and maintenance costs. Compared with a conventional beam pumping unit system, in the multi-phase controlled multi-well pumping unit according to the present invention reduces an average maximum load by 86.2%, an alternating load by 87.9%, and a total weight, installed power and size by 89.9% when one power part drives eight wells. Energy consumption of the multi-well pumping unit system is effectively reduced, thereby improving efficiency.

DESCRIPTION OF EMBODIMENTS

To understand the foregoing objectives, features and advantages of the present invention more clearly, the present invention is further described in detail below with reference to the accompanying drawings and specific implementations.

In the description of the present invention, it should be understood that the orientation or positional relationship indicated by the terms "center", "longitudinal", "transversal". "upper", "lower", "front", "rear", "left", "right", "vertical", "horizontal", "top", "bottom". "inner", "outer", and the like is based on the orientation or positional relationship shown in the accompanying drawings, and is only for ease of describing the present invention and simplifying the description, rather than indicating or implying that an indicated apparatus or component must have a specific orientation or must be constructed and operated in a specific orientation. Therefore, this cannot be understood as a limitation on the present invention. In addition, the terms "first" and "second" are used for description only, and cannot be understood as indicating or implying relative importance or implicitly indicating the quantity of indicated technical features. Thus, the features defined by "first", "second" and the like can explicitly or implicitly include one or more of the features. In the description of the present invention, unless otherwise specified, "a plurality of" means two or more. The terms "mount". "connection", and "connect" should be understood in a broad sense. For example, "connection" may be a fixed connection, or a detachable connection, or an integrated connection; or a mechanical connection or an electrical connection; or a direct connection, an indirect connection through an intermediate medium, or internal communication between two elements. For a person of ordinary skill in the art, specific meanings of the above-mentioned terms in the present invention may be understood based on specific situations.

Figure 1:
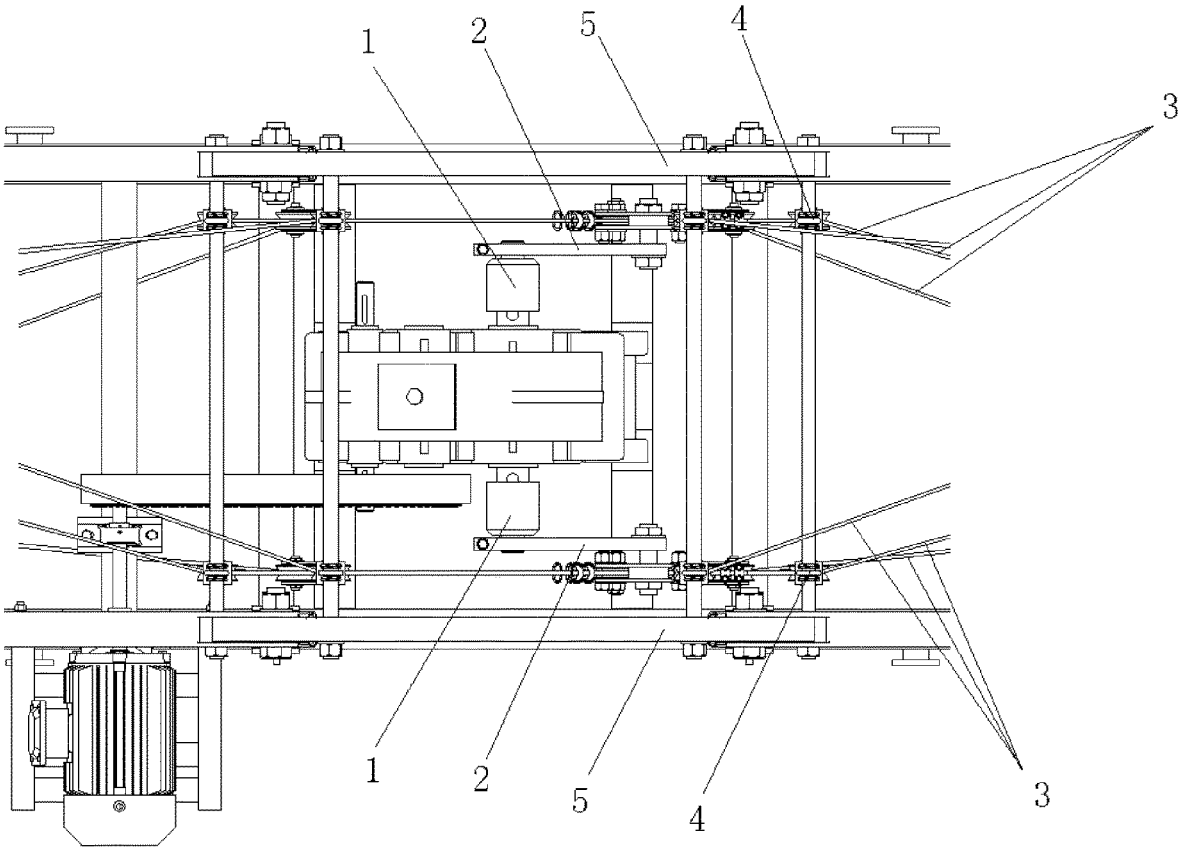
FIG. 1 is a schematic diagram of a partial top view of a multi-phase controlled multi-well pumping unit according to an embodiment of the present invention.
Figure 2:
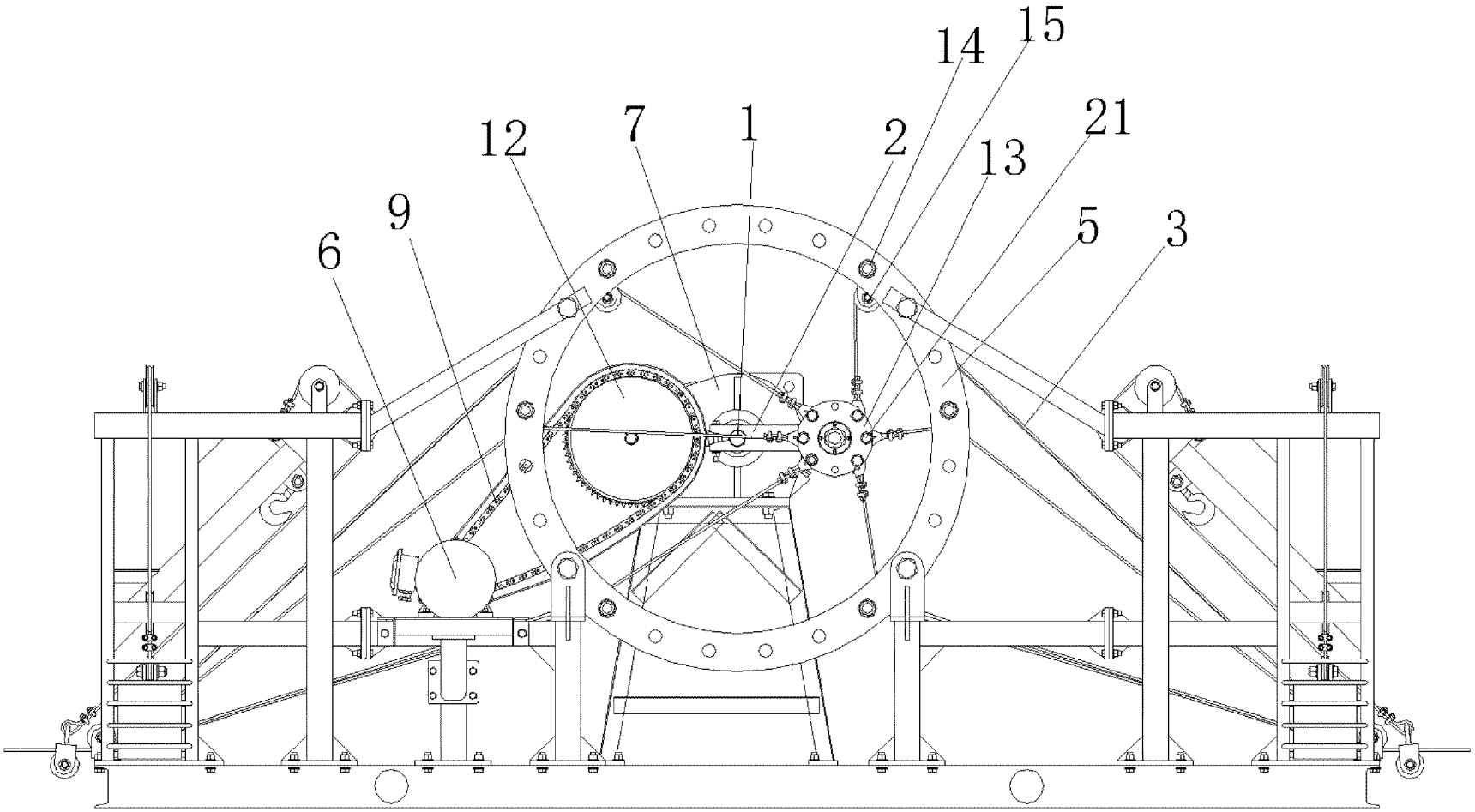
FIG. 2 is a schematic diagram of a partial front view of a multi-phase controlled multi-well pumping unit according to an embodiment of the present invention.
Figure 3:
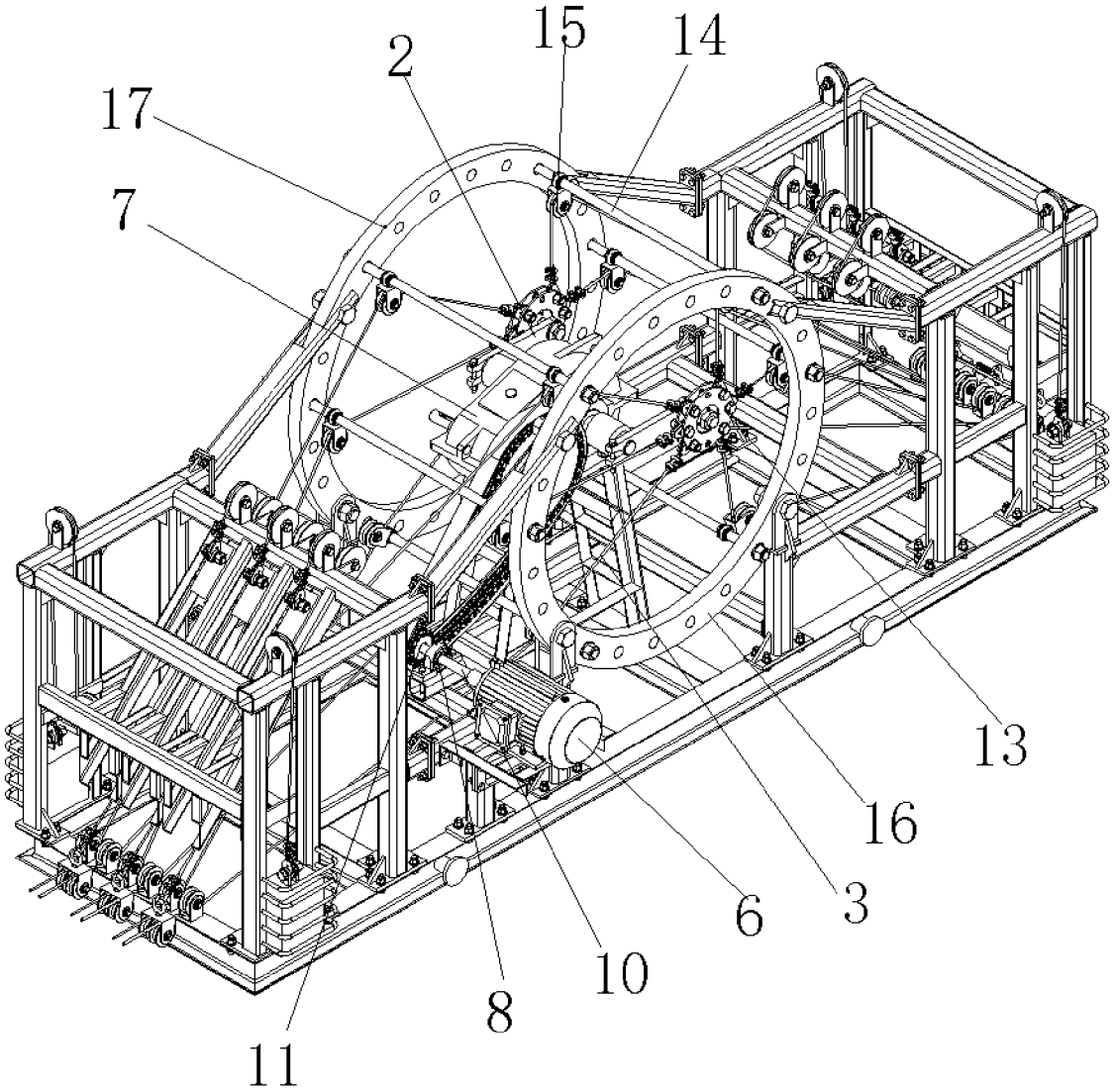
FIG. 3 is a schematic diagram of a partial three-dimensional structure of a multi-phase controlled multi-well pumping unit according to an embodiment of the present invention.

As shown in FIG. 1, FIG. 2 and FIG. 3, a multi-phase controlled multi-well pumping unit according to the present invention includes: a power part, where the power part outputs torque through a rotating shaft 1; a crank part, where the crank part includes two crank mechanisms 2, the two crank mechanisms are fixedly connected to two end parts of the rotating shaft respectively, and a free end of each of the crank mechanisms is connected to flexible power ropes 3; and a power output part, where the power output part includes a plurality of flexible-power-rope guide components 4 distributed in different phases (angles) along the radial direction of the output shaft (vertical output shaft), and the plurality of flexible-power-rope guide components are fixed to a power output frame 5; where the free end of each of the crank mechanisms is fixedly connected to one ends of the flexible power ropes, and the other ends of the flexible power rope provide power output to the outside through the flexible-power-rope guide components. The symmetrical crank mechanisms each drive a plurality of flexible power ropes to output power, and two flexible power ropes moving synchronously jointly drive one pumping well.

In this embodiment, the rotating shaft of the power part is configured as a single shaft with dual outputs, and the frame has a compact structure, that is, the two crank mechanisms are fixed at two ends of the rotating shaft. The synchronous rotation of the two cranks drives the plurality of groups of flexible power ropes to reciprocate to output power, so that the rotating shaft and the frame are properly stressed. The plurality of groups of flexible power ropes and the flexible-power-rope guide components with uniformly distributed phases (for example, universal fixed pulleys) drive 3-25 or even more wells. Pumping wells may be uniformly distributed on the same straight line, or may be arranged non-uniformly and non-linearly. A lateral foundation ensures lateral stress balance of a power base, and balance in a linear direction depends on stress balance among multiple wells. The universal fixed pulleys achieve mechanical and dynamic balance in the process of energy transmission of the multi-well pumping unit, simplify the system structure, enable the multi-well pumping unit to have a proper system structure and be properly stressed, and bring functions and superior characteristics of the multi-well pumping unit into better play. A universal pulley block system structure is used to optimize the layout, and the foundation, the frame, the pulley block, a wheel connection system and an adjustment mechanism are used to achieve main functions: the flexible power ropes fall to the ground, power transmission on both sides is unified, an angle of transmission from the flexible power ropes to a single well is accurately changed, and power of a main engine of the pumping unit is properly transmitted to each driven single well for reciprocating oil pumping. The stroke and balance of a single well can be adjusted by a wellhead power conversion apparatus; and a higher yield and lower energy consumption can also be achieved by arranging a non-leakage oil well pump.

Figure 4:
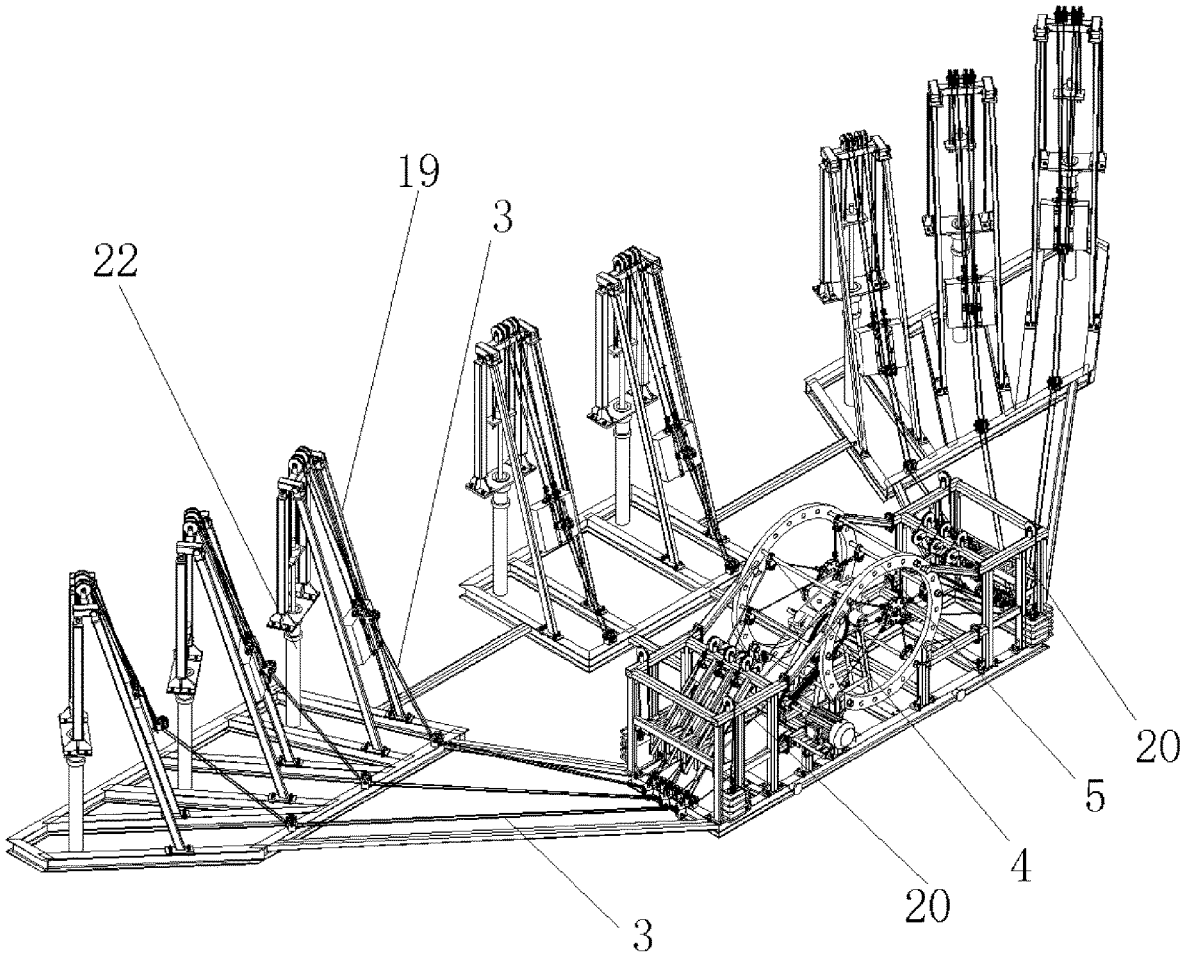
FIG. 4 is a schematic diagram of an overall structure of a multi-phase controlled multi-well pumping unit according to an embodiment of the present invention.

According to the foregoing embodiment, preferably, as shown in FIG. 4, the multi-phase controlled multi-well pumping unit disclosed in the present invention further includes wellhead stroke adjustment mechanisms 19, where the wellhead stroke adjustment mechanisms each specifically include an input pulley, a component for adjusting an effective length of a flexible power rope, and an output pulley, and each of the flexible power ropes is connected to the component for adjusting an effective length of a flexible power rope through the input pulley, and is connected to a wellhead oil pumping component 22 through the output pulley after an effective length of the flexible power rope is adjusted.

In this embodiment, coaxial pulleys (rollers) with different diameters are used to change a diameter combination and adjust a reciprocating stroke length. A flexible-power-rope input end from the power part is fixed to a fixed pulley with one diameter, and a flexible-rope output end that is connected to a wellhead rope hanger is fixed to another fixed pulley with a different diameter. Reciprocating motion is performed under the two-way restriction of main power of the power part and a sucker rod pump. Independent stroke adjustment of an oil pumping component in each pumping well is achieved, which plays an important role in flexible adjustment and stable operation of the multi-well pumping unit system.

According to the foregoing embodiment, preferably, as shown in FIG. 4, the multi-phase controlled multi-well pumping unit disclosed according to the present invention further includes single-well shutdown balance mechanisms 20, where each of the single-well shutdown balance mechanisms specifically includes a balance rope, a balance counterweight, a plurality of input pulleys, a plurality of flexible-power-rope control sliding sleeves, a plurality of hooks, a plurality of hook connecting ropes, and a plurality of limit blocks, where the flexible power ropes led out by the flexible-power-rope guide components run through the input pulleys and the flexible-power-rope control sliding sleeves to output power to the outside, the limit blocks are fixed to the flexible power ropes on an output side of the flexible-power-rope control sliding sleeves, one ends of the hook connecting ropes are connected to the hooks, and the other ends of the hook connecting ropes are connected to the flexible-power-rope control sliding sleeves; and after the flexible power ropes lose wellhead tension, the limit blocks drive the flexible-power-rope control sliding sleeves to move and further drive the hooks to move, so that the hooks are hung on the balance rope, and the balance rope drives the balance counterweight to reciprocate up and down to simulate the wellhead tension.

In this embodiment, when the pumping unit drives a plurality of pumping wells to operate, upon a pumping stop caused by a single-well fault, the single-well shutdown balance mechanism converts a load of the faulted well into a standby load, so as to avoid affecting the normal operation of the system and an operating time rate of the multi-well pumping unit.

According to the foregoing embodiment, preferably, the multi-phase controlled multi-well pumping unit further includes a flexible-power-rope quick disconnection mechanism, where the flexible-power-rope quick disconnection mechanism specifically includes a flexible-power-rope input end, a control rope, a sleeving mechanism, a disconnection clamping claw, and a flexible-power-rope output end that are connected in sequence; the sleeving mechanism includes an outer sleeve and an inner sleeve, and the disconnection clamping claw is disposed in the sleeving mechanism to fix the outer sleeve and the inner sleeve; and each of the flexible power ropes pulls the control rope after being overloaded, and the control rope further drives the outer sleeve to move to trigger the disconnection clamping claw, so that the outer sleeve is separated from the inner sleeve.

In this embodiment, as a weak link in a pumping unit power transmission system, the flexible-power-rope quick disconnection mechanism provides an overload protection function, and a tension sensor may be further disposed on the flexible-power-rope quick disconnection mechanism to calculate a single-well load.

According to the foregoing embodiment, preferably, the multi-phase controlled multi-well pumping unit further includes an artificial intelligence management system, where the artificial intelligence management system includes an electrical parameter collection apparatus and a flexible rope tension detection apparatus, which are configured to collect electrical parameters of the pumping unit and stress data of a single-well flexible rope and upload the electrical parameters and the stress data to an oil field management cloud platform.

In this embodiment, the pumping unit system supports arrangement of a single-well load displacement sensor and matched intelligent system software, to intelligently calculate a single-well fluid flow pressure, diagnose and analyze more than 100 working condition items of a pump, and achieve adjustment of the main engine related to the system stroke and stroke times and optimal control over machines, pumps, wells and layers and between wells.

According to the foregoing embodiment, preferably, the rotating shaft is located at the center of the power output frame.

According to the foregoing embodiment, preferably, the power part specifically includes a motor 6 and a reducer 7, where the motor and the reducer are connected by a transmission mechanism, and a power output shaft of the reducer serves as the rotating shaft.

According to the foregoing embodiment, preferably, the transmission mechanism specifically includes an overload clutch 8, a chain 9, a sprocket, and a transmission shaft 10, where the overload clutch and the sprocket are coaxially connected to the motor through the transmission shaft, and the chain connects a motor sprocket 11 to a reducer sprocket 12, so that the motor drives the reducer.

According to the foregoing embodiment, each of the crank mechanisms specifically includes a crank and a flexible-power-rope connecting disc 13, where the flexible-power-rope connecting disc is fixed to a free end of the crank, and the flexible-power-rope connecting disc is provided with a plurality of flexible-power-rope fixing holes 21.

According to the foregoing embodiment, preferably, the flexible-power-rope guide components are uniformly fixed to the power output frame, and each of the flexible-power-rope guide components 4 specifically includes a horizontal shaft 14 and two pulleys 15 fixed to the horizontal shaft; and the power output frame specifically includes a frame, a first track 16, and a second track 17, the first track and the second track have the same structure and are coaxially fixed to the frame, and two ends of the horizontal shaft are vertically fixed between the first track and the second track.

According to the foregoing embodiment, preferably, the first track and the second track are circular or regular polygons.

According to the foregoing embodiment, preferably, the multi-phase controlled multi-well pumping unit further includes an electric control box, where the electric control box is connected to the power part.

According to the foregoing embodiment, preferably, the multi-phase controlled multi-well pumping unit further includes a braking apparatus, where the braking apparatus is connected to the power part.

According to the foregoing embodiment, preferably, the oil pumping component specifically includes a non-leakage oil well pump disposed in a pumping well, where the flexible power ropes are connected to the non-leakage oil well pump through a sucker rod.

The multi-phase controlled multi-well pumping unit according to the present invention drives the dual cranks by two ends of the rotating shaft to serve as a power source, and the dual-crank power output mechanism leads out a plurality of groups of flexible power ropes to drive, by using the uniformly distributed guide components, a plurality of pumping wells to operate. Well-to-well inefficacy load (sucker rod weights) counteracts each other, and uniform distribution of alternating loads tends to be constant. The stress on the system is reasonable and tends to be constant. A motor tends to be efficient in working. Such practice solves problems such as improper stress, high energy consumption, and low efficiency in oil pumping using a conventional walking beam, and achieves objectives of greatly saving energy, improving efficiency and reducing device investment and maintenance costs. Compared with a conventional beam pumping unit system, in the multi-phase controlled multi-well pumping unit according to the present invention reduces an average maximum load by 86.2%, an alternating load by 87.9%, and a total weight, installed power and size by 89.9% when one power part drives eight wells. Energy consumption of the multi-well pumping unit system is effectively reduced, thereby improving efficiency.

The foregoing descriptions are merely preferred embodiments of the present invention and are not intended to limit the present invention. For a person skilled in the art, various modifications and changes may be made to the present invention. Any modification, equivalent replacement, improvement and the like made within the spirit and principle of the present invention shall fall within the protection scope of the present invention.

What is claimed is:

1. A multi-phase controlled multi-well pumping unit, comprising:

a power part, wherein the power part outputs torque through a rotating shaft;

a crank part, wherein the crank part comprises two crank mechanisms, wherein each of the two crank mechanisms specifically comprises a crank and a flexible-power-rope connecting disc, wherein the crank comprises one end and a free end, the one end of the crank is fixedly connected to a respective one of two end parts of the rotating shaft, and the flexible-power-rope connecting disc is fixed to the free end of the crank, and the flexible-power-rope connecting disc is provided with a plurality of flexible-power-rope fixing holes; and a power output part, wherein the power output part comprises a plurality of circumferentially and uniformly distributed flexible-power-rope guide components, and the plurality of flexible-power-rope guide components are fixed to a power output frame, wherein flexible power ropes each include a first end and a second end, the first ends of the flexible power ropes are fixedly connected to the flexible-power-rope fixing holes, respectively, and the second ends of the flexible power ropes provide power output to a wellhead oil pumping component through the flexible-power-rope guide components.

2. The multi-phase controlled multi-well pumping unit according to claim 1, further comprising:

wellhead stroke adjustment mechanisms, wherein the wellhead stroke adjustment mechanisms each specifically comprise an input pulley, a component for adjusting an effective length of a flexible power rope, and an output pulley, and each of the flexible power ropes is connected to the component for adjusting an effective length of a flexible power rope through the input pulley, and is connected to the wellhead oil pumping component through the output pulley after an effective length of the flexible power rope is adjusted.

3. The multi-phase controlled multi-well pumping unit according to claim 2, further comprising a non-leakage oil well pump, wherein the non-leakage oil well pump is disposed in a pumping well, and the flexible power ropes are connected to the non-leakage oil well pump through a sucker rod.

4. The multi-phase controlled multi-well pumping unit according to claim 1, further comprising:

single-well shutdown balance mechanisms, wherein each of the single-well shutdown balance mechanisms specifically comprises a balance rope, a balance counterweight, a plurality of input pulleys, a plurality of flexible-power-rope control sliding sleeves, a plurality of hooks, a plurality of hook connecting ropes, and a plurality of limit blocks, wherein the flexible power ropes led out by the flexible-power-rope guide components run through the input pulleys and the flexible-power-rope control sliding sleeves to output power to the outside, the limit blocks are fixed to the flexible power ropes on an output side of the flexible-power-rope control sliding sleeves, one ends of the hook connecting ropes are connected to the hooks, and the other ends of the hook connecting ropes are connected to the flexible-power-rope control sliding sleeves; and after the flexible power ropes lose wellhead tension, the limit blocks drive the flexible-power-rope control sliding sleeves to move and further drive the hooks to move, so that the hooks are hung on the balance rope, and the balance rope drives the balance counterweight to reciprocate up and down to simulate the wellhead tension.

5. The multi-phase controlled multi-well pumping unit according to claim 4, further comprising a non-leakage oil well pump, wherein the non-leakage oil well pump is disposed in a pumping well, and the flexible power ropes are connected to the non-leakage oil well pump through a sucker rod.

6. The multi-phase controlled multi-well pumping unit according to claim 1, further comprising:

a flexible-power-rope quick disconnection mechanism, wherein the flexible-power-rope quick disconnection mechanism specifically comprises a flexible-power-rope input end, a control rope, a sleeving mechanism, a disconnection clamping claw, and a flexible-power-rope output end that are connected in sequence; the sleeving mechanism comprises an outer sleeve and an inner sleeve, and the disconnection clamping claw is disposed in the sleeving mechanism to fix the outer sleeve and the inner sleeve; and each of the flexible power ropes pulls the control rope after being overloaded, and the control rope further drives the outer sleeve to move to trigger the disconnection clamping claw, so that the outer sleeve is separated from the inner sleeve.

7. The multi-phase controlled multi-well pumping unit according to claim 6, further comprising a non-leakage oil well pump, wherein the non-leakage oil well pump is disposed in a pumping well, and the flexible power ropes are connected to the non-leakage oil well pump through a sucker rod.

8. The multi-phase controlled multi-well pumping unit according to claim 1, further comprising:

an artificial intelligence management system, wherein the artificial intelligence management system comprises an electrical parameter collection apparatus and a flexible rope tension detection apparatus, which are configured to collect electrical parameters of the pumping unit and stress data of the flexible power rope and upload the electrical parameters and the stress data to an oil field management cloud platform.

9. The multi-phase controlled multi-well pumping unit according to claim 1, wherein the power part specifically comprises a motor and a reducer, the motor and the reducer are connected by a transmission mechanism, and a power output shaft of the reducer serves as the rotating shaft.

10. The multi-phase controlled multi-well pumping unit according to claim 9, wherein the transmission mechanism specifically comprises an overload clutch, a chain, sprockets, and a transmission shaft, wherein the overload clutch and the sprocket are coaxially connected to the motor through the transmission shaft, and the chain connects a motor sprocket to a reducer sprocket, so that the motor drives the reducer.

11. The multi-phase controlled multi-well pumping unit according to claim 1, wherein each of the flexible-power-rope guide components specifically comprises a horizontal shaft and two pulleys fixed to the horizontal shaft; and the power output frame specifically comprises a frame, a first track, and a second track, the first track and the second track have the same structure and are coaxially fixed to the frame, and two ends of the horizontal shaft are vertically fixed between the first track and the second track.

12. The multi-phase controlled multi-well pumping unit according to claim 1, further comprising a non-leakage oil well pump, wherein the non-leakage oil well pump is disposed in a pumping well, and the flexible power ropes are connected to the non-leakage oil well pump through a sucker rod.

13. The multi-phase controlled multi-well pumping unit according to claim 1, further comprising a non-leakage oil well pump, wherein the non-leakage oil well pump is disposed in a pumping well, and the flexible power ropes are connected to the non-leakage oil well pump through a sucker rod.

* * * * *